United States Patent [19]

Honsel

[11] Patent Number: 4,789,350

[45] Date of Patent: Dec. 6, 1988

[54] METHOD AND APPARATUS FOR MANUFACTURING MAILING ENVELOPES OR BAGS

[76] Inventor: Karl-Heinz Honsel, Heidelberger Weg 15, 4800 Bielefeld 1, Fed. Rep. of Germany

[21] Appl. No.: 38,550

[22] Filed: Apr. 15, 1987

[30] Foreign Application Priority Data

Apr. 19, 1986 [DE] Fed. Rep. of Germany ..... 3613243

[51] Int. Cl.[4] ..... B31B 23/16; B31B 23/22; B31B 1/25

[52] U.S. Cl. ..... 493/232; 493/228; 493/233

[58] Field of Search ..... 493/227, 228, 229, 230, 493/231, 232, 233, 234, 235, 236, 237

[56] References Cited

U.S. PATENT DOCUMENTS

| | | | |
|---|---|---|---|
| 1,525,356 | 2/1925 | Arrouquier | 493/235 |
| 1,798,168 | 3/1931 | Poppe | 493/235 |
| 2,129,842 | 9/1938 | Holweg | 493/234 |
| 2,569,630 | 10/1951 | French | 493/232 |
| 3,390,617 | 7/1968 | Cloud et al. | 493/227 |

FOREIGN PATENT DOCUMENTS

| | | | |
|---|---|---|---|
| 647889 | 7/1937 | Fed. Rep. of Germany | 493/236 |
| 1436785 | 3/1969 | Fed. Rep. of Germany | 493/230 |
| 494040 | 10/1938 | United Kingdom | 493/235 |

*Primary Examiner*—Frederick R. Schmidt
*Assistant Examiner*—William E. Terrell
*Attorney, Agent, or Firm*—Laubscher & Laubscher

[57] ABSTRACT

In the inventive method mailing bags are manufactured in an appropriately constructed flat- and lateral folding back machine. A tube fabricated from a web is provided in the region of its longitudinal borders with two triangularly-shaped and punched cut-outs, through which there are defined subsequent separating lines for separating individual tubular pieces from the tube. One or an upper panel of the tube is obtained by two separating cuts spaced parallel from, and at a distance from one another, while the lower panel is obtained by a separating cut positioned between the afore-described separating cuts for the upper panel. The bottom closure and the closure cap of the mailing bag are formed by these cuts.

4 Claims, 3 Drawing Sheets

METHOD AND APPARATUS FOR MANUFACTURING MAILING ENVELOPES OR BAGS

BACKGROUND OF THE INVENTION

The present invention relates to the manufacture of bags in general, and more particularly to a method of and arrangement for manufacturing paper bags, especially flat and lateral fold bags for mailing.

There are already known various methods of and arrangements for manufacturing paper bags of the type here under consideration, among them such in which a tube is being shaped from a paper web withdrawn from a roll while simultaneously forming a longitudinal seam. Then, individual tubular pieces are separated from the tube in such a manner that the transverse end edges that are associated with one another and that are constituted on the circumferential panels of the bag extend parallel to one another and at a distance from each other. Finally, the leading ends of the tubular pieces are folded and closed for the formation of the respective bags.

The bags which are being manufactured in accordance with both the conventional methods and arrangements and those of the present invention are to be used for the packaging of various goods or items. Depending on their configuration, the respective bags may be classified as flat bags, lateral fold bags and amiling envelopes. Many modifications or these bag types may be contemplated.

Ordinarily, for the manufacture of the bags, individual tubular sections are separated from a tube that is shaped from a web. Usually, the shaping of the tube is accomplished in such a manner that the outer regions of the web are folded over toward the center such that the longitudinal marginal portions of the web overlap one another and form a so-called longitudinal seam. To the extent that the material of the bag is capable of being adhesively connected, such as paper, the marginal portions of the web are glued to one another to form the tube by means of an adhesive strip that is applied to the web. Usually, the shaping of the tube is performed in such a manner that the region of the tube which includes the longitudinal seam is situated at the upwardly facing portion of the tube from which one of the major panels of the bag is to be formed.

The separation of the individual tubular pieces for the formation of the bags is occasionally achieved in such a manner that the transversely extending end edges which are provided on the major panels of the bag extend at such a longitudinal offset from one another that the transverse end edge which is formed on the upper layer is offset rearwardly, as considered in the advancement direction, from the end edge that is formed on the lower layer of the tube and thus of the tubular piece formed therefrom. As a result of this, the lower layer of the respective tubular piece is connectable with the upper layer by folding-over of the leading end of the respective tubular piece. In addition, the edge portion which is provided on the upper layer of each of the tubular pieces at the trailing end thereof projects beyond the edge of the lower layer. Inasmuch as the trailing end eventually constitutes the filling opening of the bag, the projecting edge portions of the upper layer of the respective tubular pieces can also be considered as to constitute respective projecting flaps. The introduction of the goods or items into the bag is considerably facilitated by using this expedient. As far as the handling of the bags is concerned, the bag major panel which is provided with the longitudinal seam can be designated as the rear panel and the other major panel as the front panel.

The separation of the tube into the individual tubular pieces can be accomplished in various ways. So, for instance, the web may be provided prior to the shaping or deformation thereof into the tube with weakening lines which extend over the entire width of the web and which are so arranged that there is obtained the desired offset of the end edges after the tearing-off along these weakening lines. In accordance with another known method, the separation occurs with a so-called zigzag cut by means of sawtooth-shaped cutting blades or knives. The cutting blades may either by arranged stationarily, in which case the actual cut is accomplished by means of a knockover or backing-off element that rotates transversely to the transportation or advancement direction, or, in another construction, they may be mounted on rotating cylinders. In all of the known methods of separation of the tubular pieces from the tube, the projecting open end edges no longer satisfy, owing to the utilization of the zigzag cutting blades or the tearing-off along the weakening lines, the current requirements, especially since an advertising effect is to be achieved as well during the purchase of goods by the bags and their appearance.

A further disadvantage is to be seen in the fact that, especially when the separation is being achieved by the use of the rotating knockover element, the level of the noise generated by the machine is too high, so that the annoyance of the operating personnel by this noise is no longer acceptable, with the result that noise-damping measures become necessary.

SUMMARY OF THE INVENTION

Accordingly, it is a general object of the present invention to avoid the disadvantages of the prior art.

More particularly, it is an object of the present invention to provide a method of manufacturing bags for mailing, which does not possess the drawbacks of the known methods of this type.

Still another object of the present invention is to devise a method of the type here under consideration which renders it possible to improve the quality of the free end edges of the bag.

It is yet another object of the present invention to develop an arrangement capable of performing the above method.

A concomitant object of the present invention is so to construct the arrangement of the above type as to be relatively simple in construction, inexpensive to manufacture, easy to use, and yet reliable in opeation.

An additional object of the present invention is to design the above arrangement in such a manner as to keep the level of noise generated thereby to a minimum.

These objects are attained, according to the invention, by providing two separating cuts in parallel and at a spacing from one another along those regions of the tube which are to become the one or upper of the major panels, opening the tube between the separating cuts in a region of longitudinal edges of the tube, and cutting the other or lower of the major panels by a cut taking place between the separating cuts of the one of the major panels.

By opening the tube within the region of the longitudinal edges, and by the separating cuts extending perpendicularly to the tube edges there is cut out from the upper panel formed with the longitudinal seam a shaped piece. Since the cut for the lower panel for final cutting of the tube into individual tubular pieces takes place betwen the separating cuts of the upper panel, the bottom caps and closure caps are formed from the lower panel of the tube. The particular advantage of the inventive method can be seen therein that the efficiency of a machine operating along such a principle is particularly high.

Advantageously the step of opening the tube along regions thereof which are to become the one of the major or upper panels, and along longitudinal edges thereof is accomplished prior to the separating cut steps; as a result thereof the appropriate machine, as seen in the direction of travel of the tube is disposed upstream of the device for providing the separating cuts.

In an advantageous manner the tube is opened along the regions thereof which are to become the major panels so as to form triangularly shaped cut-outs, an imaginary base of the cut-outs forming an extension of longitudinal edges of the tube. The cut-outs can then be punched out in a particularly simple manner by rotatating punching tools. Furthermore the bottom closures and closure caps are then shaped in the usual, trapezoidal shape. The cutting step for the other of the major panels, or the lower panels, then takes place between apices of the triangular cut-outs.

So as to obtain a match with the general form of a mailing bag, in which the height of the closure caps exceeds that of the bottom cap, a distance defined between the cut taking place in the other or lower of the major panels, as viewed along a direction of travel of the tube, and a leading separating cut of the upper or one of the major panels, is greater than a corresponding distance between the cut taking place in the other or lower of the major panels, and a trailing of the separating cuts of the one or upper of the major panels. The height of the closure cap of the bottom cap is understood as that measure, which extends transversely to the longitudinal seam. so as to both facilitate folding of the bottom cap for fabrication of the mailing bag, as well as the closure of the mailing bag following filling thereof with objects, it is advantageous if the separating cuts for the one or upper of the major panels also result in weakening lines in corresponding other or lower of the major panels.

So as to obtain these weakening lines, only an appropriate adjustment of the separating tools carrying out the separating cuts for the upper or one major panel is needed. Furthermore, it is ensured that the upper panel is completely cut. The device required for the cutting of the upper and lower panels becomes particularly simple in construction, if the separating cut taking place in the lower panel occurs in time after one of the separating cuts of the one of the major panels, but before the the other of the separating cuts of the same of the major panels, as, in the case of use of cutting rollers equipped with corresponding cutters, the lower cutting cylinder forms an abutment for the cutters of the upper cutting cylinder.

BRIEF DESCRIPTION OF THE DRAWING

The present invention will be described below in more detail with reference to the accompanying drawing, in which.

DETAILED DESCRIPTION OF THE PREFERRED EMBODIMENT

Figure 1:
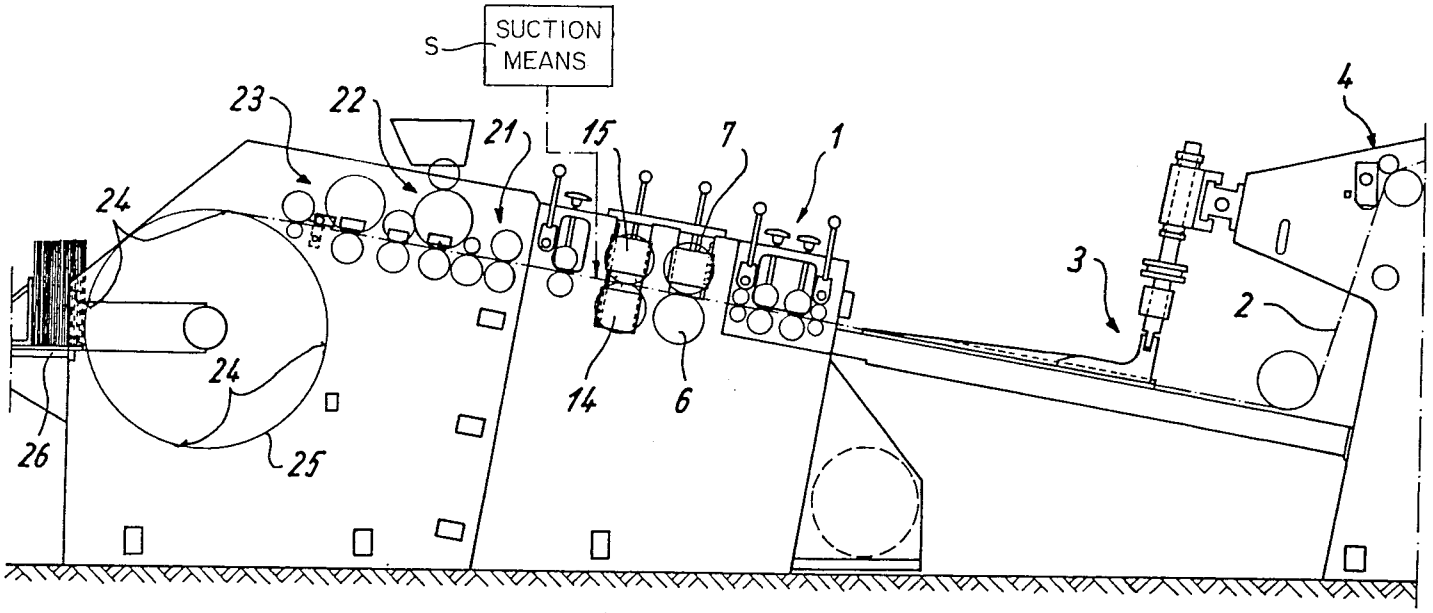
FIG. 1 is a considerably simplified schematic side elevational view of a machine for manufacturing mailing bags in accordance with the present invention.
Figure 2:
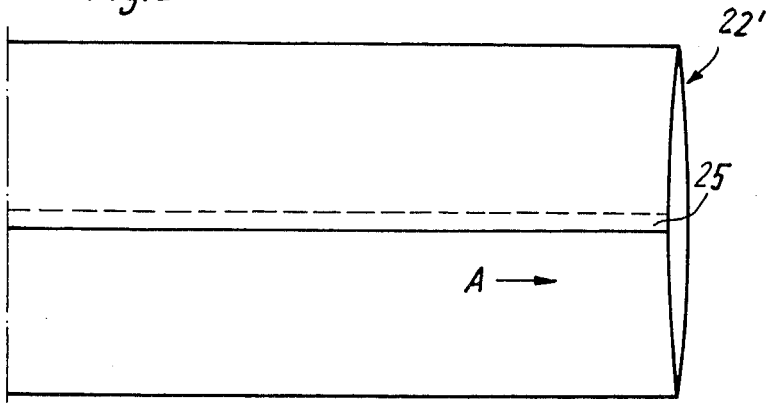
FIG. 2 is a fragmentary view of a tube formed from a web in accordance with the present invention.
Figure 3:
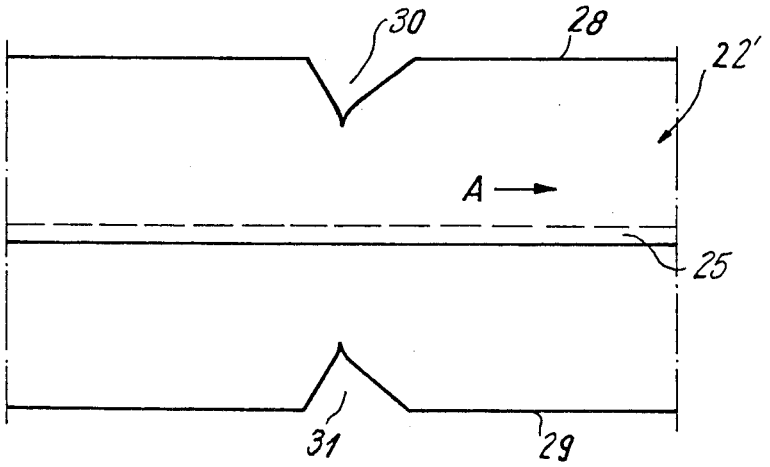
FIG. 3 is a view corresponding to FIG. 5, but wherein triangularly shaped cut-outs are in the region of the longitudinal edges of the hose.
Figure 4:
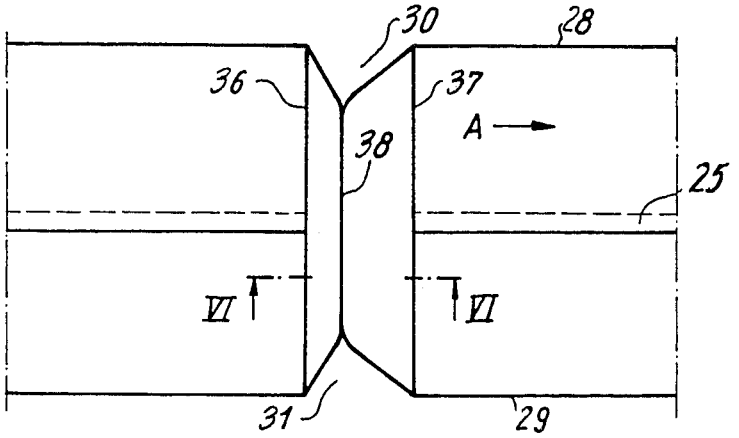
FIG. 4 is a tubular piece according to FIG. 6 with separating cuts of the upper and of the lower panel.
Figure 5:
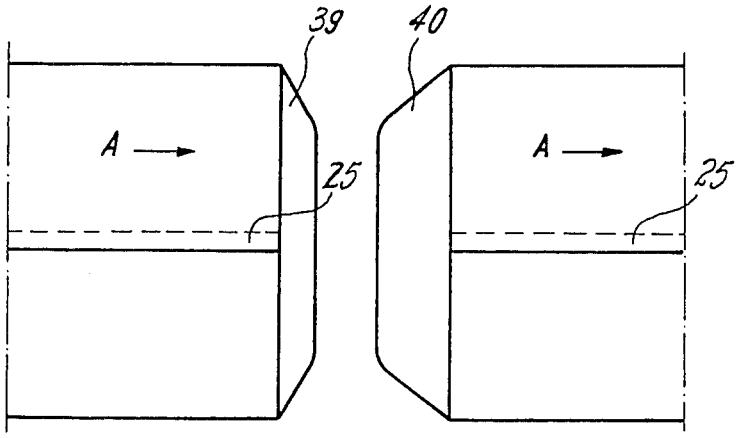
FIG. 5 is a view corresponding to that of FIG. 7, but wherein the tubular pieces are shown spaced from one another at a small distance.

Referring now to FIG. 1, the bag or envelope manufacturing machine of the present invention is adapted for the production of flat and lateral fold bags or envelopes suitable for mailing, and which essentially consists of an advance supply station 21, through which a web 22 is continuously withdrawn from a non-illustrated supply roll. As seen in the direction of movement of the web 22, there is provided in the advance supply station 21 a tube formation means 23 and a groove formation means 24 for preforming of the longitudinal edges of the fold bags suitable for mailing. The type of tube used for passage through the advance supply station 21 is shown in FIG. 2. The longitudinal seam is denoted with the reference numeral 25. In the following description the tube is denoted with the reference numeral 22'. Immediately downstream of the advance supply station 21 there is provided a punching arrangement which consists of a punching cylinder 26 disposed immediately below the tube 22', and a cutting punching cylinder 27 disposed above the tube 22'. For reasons of clarity the cutting means of the punching cylinder 27 have not been illustrated. In this station the tube 22' is cut in the region of its longitudinal edges 28,29 so as to be formed with punched cut-outs 30 and 31. The punched-out web portions are then removed by a suction arrangements. As shown in FIG. 3, the punched cut-outs are triangularly shaped. Two cutting cylinders 34, 35 are postcoupled to the cylinders 26 and 27, the tube 2' being guided through the cutting cylinders. The lower cutting cylinder 34 is provided with one cutter, and the upper cutting cylinder 35 is provided with two cutters. By means of the upper cutting cylinder 35 the up-per panel of the tube 22' is provided with two parallel separating cuts spaced from one another, and denoted by the reference numerals 36 and 38. The sheet disposed between the two separating cuts is also suctioned off in a manner which is not further illustrated. Between the two separating cuts the lower panel of the tube 22' is divided by the cutter of the cylinder 34. The cutting line is denoted in FIG. 4 with the reference numeral 38.

By cutting along the separating line 38 there is formed a bottom closure flap 39 on the advancing or leading end of the tube segment and another closure flap 40 on the trailing end of the tube segment, as can be seen from FIG. 8. The direction of travel of the tube 22' and of the separated tube segments is denoted in FIG. 2 with the reference letter A. The tube segment separated from the tube 22' is fed to a glue cutting arrangement 42 by means of an intermediate transporter 41, in which the bottom closure flap 39 is provided with a flue strip extending transversely to the transport direction. The tube segment subsequently passes through a folding arrangement 43, into which the bottom closure clap 39 tips over with that wall portion thereof which is provided with the longitudinal seam 25. By means of a cylinder 45 provided with grippers 44 the already fabricated mailable fold bags are placed upright onto a stacking table 46. Here the longitudinal seams 25 are disposed on a side facing away from the cylinder 45.

It is to be further mentioned that all punched cut-outs necessary for the manufacture of the mailable fold bags are accomplished in a smooth cutting operation, so as to obtain the desired quality of cut. From FIG. 8 it can be futhermore ascertained that the closure flap 40 can be folded only onto the wall portion provided with the longitudinal seam 25. Thus the other wall portion remains smooth for addressing purposes, and optionally for imprinting advertising material thereon.

Figure 6:
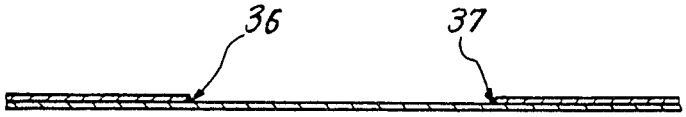
FIG. 6 is a section along line VI—VI of FIG. 7.

From FIG. 6 it can be further ascertained that for all intents and purposes a window is cut into the upper tube portion by means of the separating cuts 36, 37 in conjunction with the punched cut-outs 36, 37.

It is generally known that in mailable fold bags the height of the bottom closure cap is smaller than that of the other closure cap. For this reason the cutting cylinders 34,35 are so positioned with respect to one another that the distance of the cutting line 38 with respect to the separating cut 37 placed initially into the upper panel of the tube 22'exceeds that with respect to the separating cut 36.

In FIGS. 2–5 the longitudinal seam is approximately centered. Alternatively, this seam can also be disposed at respective unequal distances from the longitudinal boders or be situated in the region of a longitudinal border.

While the present invention has been described and illustrated herein as embodied in a specific construction of a bag-manufacturing machine, it is not limited to the details of this particular construction, since various modifications and structural changes are possible and contemplated by the present invention. Thus, the scope of the present invention will be determined exclusively by the appended claims.

I claim:

1. The method of forming a web (22) into a mailing bag such as an envelope, comprising the steps of:

(a) forming the web into a longitudinally extending flat tube (22') containing a longitudinal seam (25) and having a pair of flattened side walls joined by a pair of longitudinal edges (28,29);

(b) punching a pair of opposed corresponding generally triangular portions from the longitudinal edges of said tube, while in the flattened condition, to define a pair of triangular notches (30,31) the apices of which are spaced inwardly from said longitudinal edges;

(c) forming a pair of parallel longitudinally-spaced transversely-extending cuts (36,37) in one side wall of said tube while in the same flattened condition, said cuts extending between the junctions of said notches and said longitudinal edges, respectively;

(d) removing the portion of the flattened side wall defined between said pair of cuts; and (e) cutting the other side wall of said tube, while in the same flattened condition, along a third transversely extending cut (38) extending between the apices of the notches, thereby to sever the tube to define a tubular envelope having foldable frustoconical flaps (39,40) at opposite ends thereof.

2. The method as defined in claim 1, wherein said third cut is unequally spaced relative to said pairs of cuts, so that one of said foldable flaps is wider than the other.

3. The method as defined in claim 1, wherein the steps of forming said pair of cuts in said one tube side wall simultaneously forms corresponding lines of weakness in the other side wall, thereby to define lines of fold for said flaps, respectively.

4. Apparatus for forming a web (22) into a mailing bag such as an envelope comprising:

(a) means (24) for forming the web into a longitudinally extending flat tube (22') containing a longitudinal seam (25) and having a pair of flattened side walls joined by a pair of longitudinal edges (28, 29);

(b) means (26,27) for punching a pair of opposed correspondingly generally triangular portions from the longitudinal edges of said tube, while in the same flattened condition, to define a pair of triangular notches (30,31) the apices of which are spaced inwardly from said longitudinal edges;

(c) means (35) for forming a pair of parallel longitudinally-spaced transversely-extending cuts (36,37) in one side wall of said tube while in the same flattened condition, said cuts extending between the junctions of said notches and said longitudinal edges, respectively;

(d) means (S) for removing the portion of the flattened side wall defined between said pair of cuts; and (e) means (34) for cutting the other side wall of said tube, while in the same flattened condition, along a third transversely extending cut (38) extending between the apices of the notches, thereby to sever the tube to define a tubular envelope having foldable frustoconical flaps (39,40) at opposite ends thereof.

* * * * *